US007330000B2

(12) United States Patent
Limor

(10) Patent No.: US 7,330,000 B2
(45) Date of Patent: Feb. 12, 2008

(54) DISCHARGE LIGHTING BULBS CONTROL SYSTEM

(76) Inventor: Shimon Limor, Alexandrony st 2, Ashqelon (IL)

( * ) Notice: Subject to any disclaimer, the term of this patent is extended or adjusted under 35 U.S.C. 154(b) by 0 days.

(21) Appl. No.: 11/347,797

(22) Filed: Feb. 3, 2006

(65) Prior Publication Data

US 2007/0182341 A1 Aug. 9, 2007

(51) Int. Cl.
*G05F 1/00* (2006.01)

(52) U.S. Cl. ..... 315/291; 315/276; 315/310

(58) Field of Classification Search ..... 315/209 R, 315/224, 276, 291, 307, 225, 277, 308, 310
See application file for complete search history.

(56) References Cited

U.S. PATENT DOCUMENTS 4,469,981 A * 9/1984 Ruff et al. ..... 315/205
4,733,103 A * 3/1988 Itoh et al. ..... 307/117
5,461,286 A * 10/1995 Hirschmann ..... 315/205
5,672,963 A * 9/1997 Corrigall et al. ..... 323/339
5,952,790 A * 9/1999 Nerone et al. ..... 315/209 R
6,034,490 A * 3/2000 Yamashita et al. ..... 315/310
6,184,635 B1 * 2/2001 Boenigk ..... 315/291
6,323,604 B1 * 11/2001 Boenigk et al. ..... 315/290

* cited by examiner

*Primary Examiner*—Douglas W. Owens
*Assistant Examiner*—Jimmy Vu
(74) *Attorney, Agent, or Firm*—Malloy & Malloy, P.A.

(57) ABSTRACT

A device comprising energy saving circuitry incorporated within lighting systems of the type utilizing discharge lamps, wherein the circuitry includes at least one transformer having a primary and secondary windings oppositely wound to establish different fields of polarity. The primary winding is connectable across a supply voltage and the secondary winding is connected in series with the discharge lamps lead. A switching assembly is associated with each of the one or more transformers and is operative in a first position to connect the primary winding across the supply voltage, wherein a voltage of an opposite polarity is induced across the secondary winding. In a second operative position the one or more switch assemblies serve to disconnect the primary winding from across the supply voltage and to shunt the primary winding, so that voltage across the secondary winding is zero (v).

16 Claims, 3 Drawing Sheets

DISCHARGE LIGHTING BULBS CONTROL SYSTEM

BACKGROUND OF THE INVENTION

1. Field of the Invention

The present invention is directed to circuitry structured to control the supply voltage to electric lighting systems of the type incorporating discharge lamps, hereinafter referred to as "discharge bulbs", "discharge lamps" and/or "bulbs".

2. Description of the Related Art

The use of discharge bulbs is increasingly popular for a variety of applications in the lighting or illumination industry. Such increased acceptance and utilization is due, at least in part, to economical reasons. Minimum power consumption per lumen compares favorably as compared to lighting or illuminating systems utilizing other lighting elements such as, but not limited to, incandescent and gas lamps.

However, it has long been known that inherent economic and operational disadvantages, resulting in the waste of electrical energy in many circuit structures and/or designs associated with conventional illumination systems, are due to the believed necessity of inductive loads. Such inductive loads play a role during the ignition and operational phases of the bulb or lighting element. Moreover, such operational or performance characteristics have no functional benefit other than limiting or restricting electrical current. Therefore, the presence of an inductance in the manner herein described comprises a constant ohmic and inductive resistance, causing energy loss through heat dissipation. Also, the amount of energy wasted is directly proportional to the current value flowing therethrough.

In order to gain a better understanding and appreciation of the problems and disadvantages associated with conventional illumination system circuitry of the type described, as well as a proposed solution, an examination of a prevalent and/or conventional single phase bulb, lighting circuit, is schematically represented in the prior art circuit of FIG. 1. As shown, the prior art system comprises the primary supply voltage VPN powering the lighting circuit which also includes bulb B, inductance L and capacitor C. The capacitor C is included for adjusting the power factor of the ignition circuit.

Assuming that the bulb B is of a conventional type, such as a 150 W General Electric® Sodium high pressure bulb, it is known that the rated operating voltage thereof is 113V. However, the rated primary voltage is 230V. Obviously, the voltage drop over inductance L must be 230VAC−113VAC=200VAC. It can therefore be shown that the impedance of the inductance L is calculated and designed so that the current through the bulb B, under the above conditions, is 0.88 A. However, tests have proven that the bulb B will continue to properly function (not become extinguished) even when the voltage drop there across is lowered to 109V. Such a reduced operating voltage results in a reduction in operating current of 0.62 A, while using the same inductance L.

The following table summarizes the results of tests conducted with the 150W GE® Sodium bulb:

TABLE 1

| VPN (v) | VL (v) | Ia(A) |
|---|---|---|
| 230 | 113 | .88 |
| 225 | 113 | .35 |
| 220 | 113 | .83 |

TABLE 1-continued

| VPN (v) | VL (v) | Ia(A) |
|---|---|---|
| 215 | 113 | .81 |
| 210 | 112 | .76 |
| 205 | 111 | .72 |
| 200 | 110 | .67 |
| 195 | 109 | .62 |

The total consumption of the bulb B at a full supply voltage is 230×0.88=202 VA, and total energy consumption at the reduced voltage is 195×121 VA.

Hence, it is apparent that by reducing the input voltage by 230−195=35V (or 15%) the voltage drop on the inductance L is reduced from 200 VAC to 140 VAC, or by about 30%. Accordingly, the key for reducing the dissipated energy loss may be found in the non-linear relationship between the input voltage and the current flow through the bulb.

Various attempts have been made to accomplish the reduction of the main voltage to a minimum acceptable level without derogatorily affecting the bulb, such as by extinguishing the bulb after ignition or starting of the ionization process. However, none of the known or conventional attempts have proved to be successful, for a variety of reasons. By way of example, one such attempt incorporates the use of variac rheostats, tap changer transformers, inverters, and other devices. Such attempts are generally considered to be less than satisfactory because of, among other reasons, the step-like nature of the process and the fact that such devices are bulky, expensive and less than operationally reliable, demanding relatively frequent maintenance.

Accordingly one broad object of the present invention is to provide a method of and devices for controlling the input voltage supply of bulb lighting circuits that will effectively overcome the deficiencies of known or conventional circuitry.

It is a further object of the invention to provide a transformer-based switching system that will achieve the reduction of the input voltage in an effective manner.

It is a still further object of the invention that a switching system, as proposed herein, be readily operable by remote and/or possibly computerized means.

SUMMARY OF THE INVENTION

The present invention is directed to controlling the level of a supply voltage applied to a load, in particular one or more discharge lamps or bulbs associated with a lighting or illumination system through the utilization of customized circuitry. Accordingly, at least one preferred embodiment of the present invention comprises circuitry, as described in detail hereinafter, including at least one transformer having a primary winding being connectable across the supply voltage and a secondary winding being connected in series with the load. Further, a switching assembly is provided and operatively structured to be disposed in a first position serving to connect the primary winding across the supply voltage, thereby providing a voltage having an opposite polarity being introduced across the secondary winding of the transformer. Moreover, the switching assembly, being disposed in a second position, serves to disconnect the primary winding from across the supply voltage and to shunt the primary winding so that voltage across the secondary winding is zero (V).

Other preferred embodiments of the present invention preferably include, a modification of the control circuitry to include two or more transformers each operatively associated with a separate switching assembly. Further, the switching assemblies are structured for independent and selective actuation, preferably in succession, so that the minimum operable voltage is attained progressively.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals and letter designations refer to like parts throughout the several views of the drawings.

DETAILED DESCRIPTION OF THE PREFERRED EMBODIMENT

Figure 2:
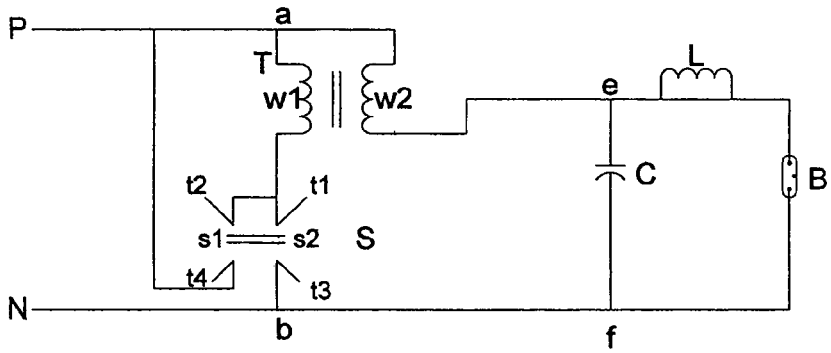
FIG. 2 is a schematic diagram of a single-phase circuit featuring the principles of one preferred embodiment of the present invention.

As disclosed in FIG. 2, one preferred embodiment of the present invention comprises a circuit which includes a transformer T having primary winding W1 and secondary winding W2. The transformer T comprises a "voltage subtraction" configuration, at least partially defined by the secondary winding W2 inducing a field of a polarity opposite to that of the primary winding W1. This is attained by reversing the winding directions of the windings W1 and W2 relative to each other.

The entrance side of both the primary and the secondary windings W1 and W2 are connected to each other at connection a. The exit side of the primary winding W1 is branched as shown and thereby configured to define or be connected to one pair of terminals t1 and t2. A double-throw, double pole switch assembly S is schematically represented and includes contacts s1 and s2 structured and positionable to establish a connection between terminals t1 and t3. Such an established connection serves to break contact between terminals t2 and t4, when the switch assembly S is in a first operative position. A second operative position of the switch assembly S is the opposite of the first operative position and establishes a connection between terminals t2 and t4 and breaks contact between terminals t1 and t3. The exit side of the secondary winding W2 is connected in series with the inductance L, as represented in the conventional or prior art circuitry of FIG. 1, as are the remaining components including bulb B and capacitor C.

The switch assembly S may be of the electromechanical relay type. However any other switching arrangement is equally applicable for the purposes of being operative in the various preferred embodiments of the present invention. Such additional appropriate switching assemblies may include, but are not intended to be limited to, electronic switch assemblies which preferably, but not necessarily, include remote control capabilities.

Figure 1:
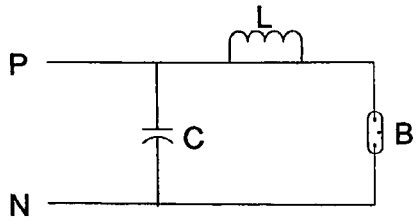
FIG 1 (PRIOR ART)
FIG. 1 is a schematic diagram of a conventional prior art discharge bulb lighting circuit.

Operation of the circuit of the preferred embodiment of FIG. 1 is as follows. At the beginning, when the bulb B is to be activated or ignited, the switch assembly S is set in the first operative position, as set forth above, wherein terminals t2 and t4 are connected and terminals t1 and t3 are disconnected. It can readily be seen that the primary supply voltage VPN will be applied across the bulb B, as required for ignition or activation thereof. This is achieved since the primary winding W1 is shunted resulting in a situation known as "self-saturation" to prevail, as relates to the transformer T. The voltage across points e and f (Vef) is thus almost equal to the primary supply voltage VPN. Hence, the voltage across the secondary winding W2 of the transformer T is forced to approach zero (v)

However, in order to reduce amperage passing the inductance L, which is a concern and one operative feature of the present invention, switch assembly S is oriented to assume its second operative position. As set forth above, the second operative position of the switch assembly S comprises the terminal t1 connected to terminal t3 and terminal t2 disconnected from terminal t4. The primary winding W1 is therefore subjected to the full supply voltage VPN, including voltage VW2 over the secondary winding W2. Since the field polarities are opposite as set forth above, the voltage Vef across points e-f is reduced by the value of VW2 compared with the supply voltage VPN. Consequently, the current passing inductance L and the bulb B is reduced by the same amount and with it the power consumption of the inductance L. It is recognized that certain resistance losses associated with the winding W2 are present but are substantially negligible in a practical application.

Accordingly it should be apparent that by suitably selecting the step-down ratio of the transformer T (W1:W2), the minimum operable "target" voltage of 195 V can be achieved (see Table 1 above) with the resulting 30% savings in energy. In the preferred embodiment of FIG. 2, this means that the secondary winding W2 is calculated to subtract 35 V from the primary supply voltage of 230v.

Figure 3:
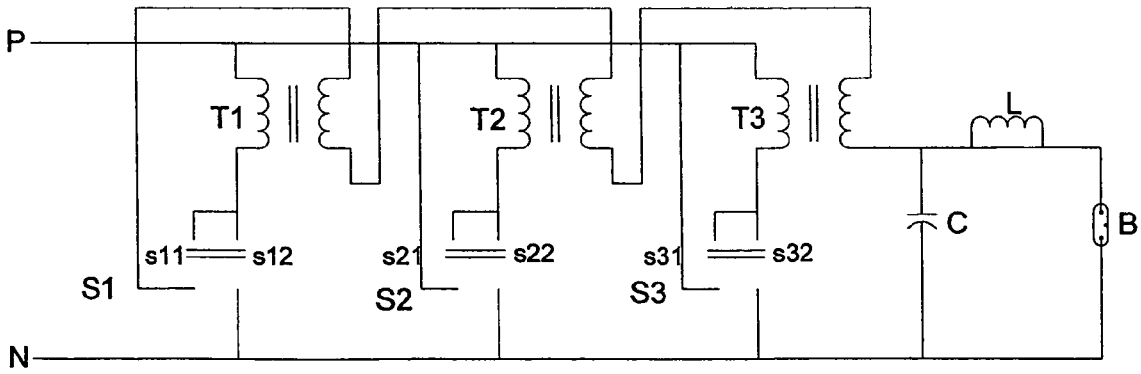
FIG. 3 is a schematic diagram of a circuit, similar to the embodiment of FIG. 2, for attaining a gradual decrease of the voltage applied to the discharge bulb and representing yet another preferred embodiment of the present invention.

In order to avoid the possibility of the discharge bulb B becoming extinguished, because of an abrupt and/or significant reduction of the operating voltage being applied thereto (from 230V to 195V), an additional preferred embodiment schematically represented by the circuit diagram of FIG. 3 is proposed. Essentially, the difference between the structure and operation of the circuit of FIG. 3 as compared with that of FIG. 2 comprises the utilization of multiple transformers T1, T2, and T3 each operatively connected in direct association with corresponding ones of the plurality of switch assemblies S1, S2, and S3. As such, a more suitable control of the switch assemblies S1, S2, and S3 is possible resulting in a progressive or more gradual reduction of the voltage applied to the bulb B.

It will be readily understood that, by denoting the voltage reduction amount of the transformers T1-T3 by R1-R3 respectively, any of the following combinations regarding the voltage applied to the bulb B (VB) can be attained:

$$VP=VPN$$

$$VB=VPN-R1$$

$$VP=VPN-R2$$

$$VP=VPN-R3$$

$$VP=VPN-(R1+R2)$$

$$VP=VPN-(R1+R3)$$

$$VP=VPN-(R2+R3)$$

$$VP=VPN-(R1+R2+R3)$$

Therefore, by suitably programming the sequence of actuations of the switches S1-S3, any of the above listed results are attainable. Applying this technique to the above example, it would be convenient to choose the following values:

R1=5V

R2=10V

R3=20V

Accordingly, at the beginning of operation relating to the ignition or activation stage, all switches will be their "first operative position" as above described, wherein the primary supply voltage VPN (230 V) will be applied to the bulb B.

The following summarizes the subsequent operational steps:

| SWITCHES OPERATED | VOLTAGE ON BULB VB |
|---|---|
| S2 | 220 |
| S1 + S2 | 215 |
| S3 | 210 |
| S1 + S3 | 205 |
| S2 + S3 | 200 |
| S1 + S2 + S3 | 195 |

By applying this sequence of switch assembly actuations, the effective bulb operating voltage will be progressively decreased by increments of 5V, as indicated. It is further noted that these switch assembly actuations can be controlled by computerized and/or remote facilities.

Figure 4:
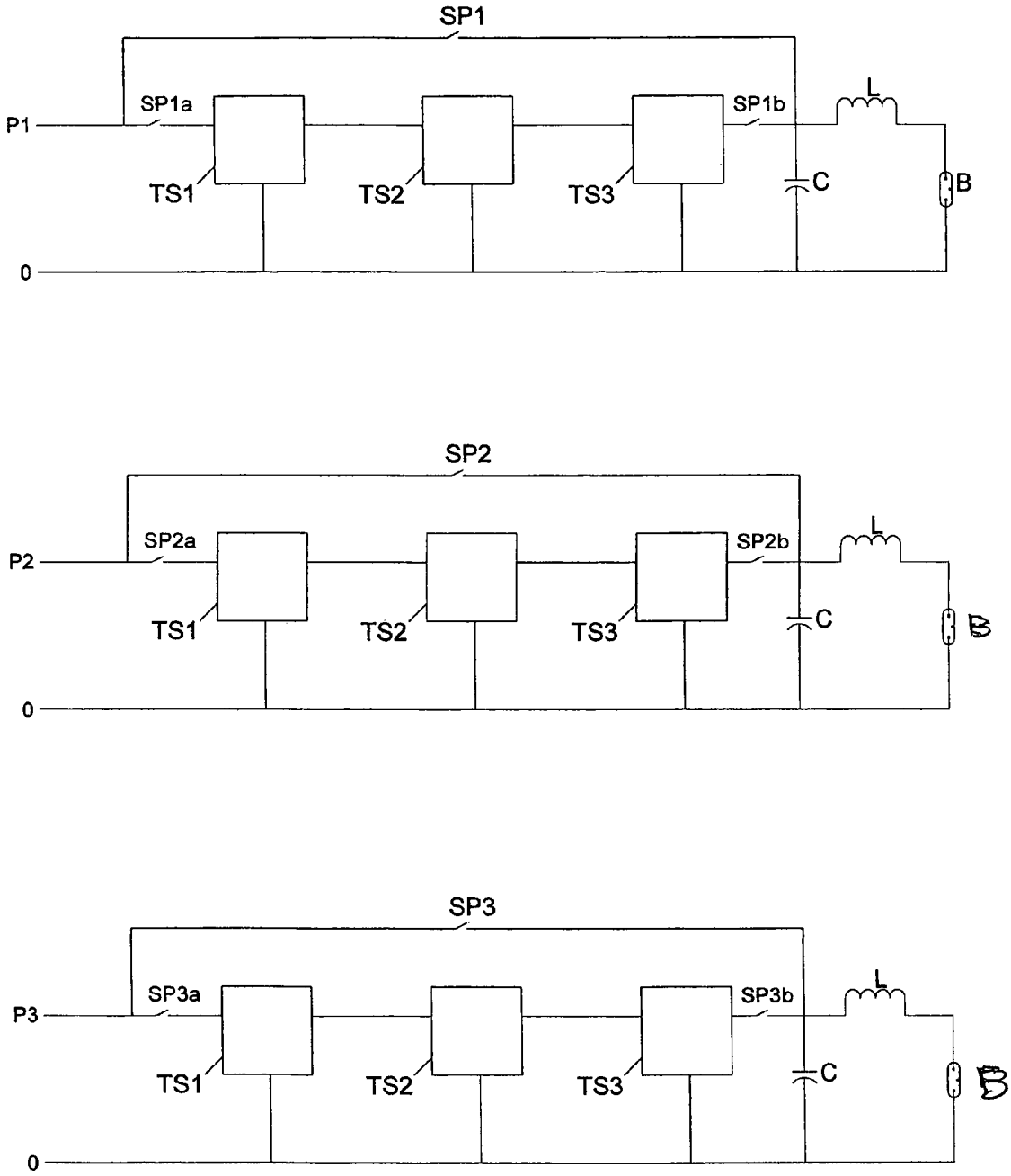
FIG. 4 is a three-part composite schematic diagram of circuitry illustrating a three-phase primary voltage supply and representing yet another preferred embodiment of the present invention.

Yet another preferred embodiment of the present invention is schematically demonstrated by the composite circuitry of FIG. 4. As indicated, this preferred embodiment of the present invention is directed to a three phase electric supply line, P1, P2 and P3. For purpose of clarity, the transformers and switching devices are schematically presented in block diagram form and collectively designated as TS1, TS2, TS3. It is to be understood that each block represents a cooperative structuring of one transformer and an associated switch assembly, as described above with reference to the embodiment of FIG. 3. Moreover, the individual bulb voltage control circuit of each phase operates in the same manner as described with reference to the embodiment of FIG. 3.

However included in the preferred embodiment of FIG. 4 is the addition of bypass ON/OFF switches SP1, SP2 and SP3. Switches SP1*a*, SP1*b*, SP2*a*, SP2*b*, and SP3*a*, SP3*b* are also provided. These may be included for protecting the respective transformers and/or, the load or discharge bulbs B against overloading and short-circuiting, respectively.

Figure 5:
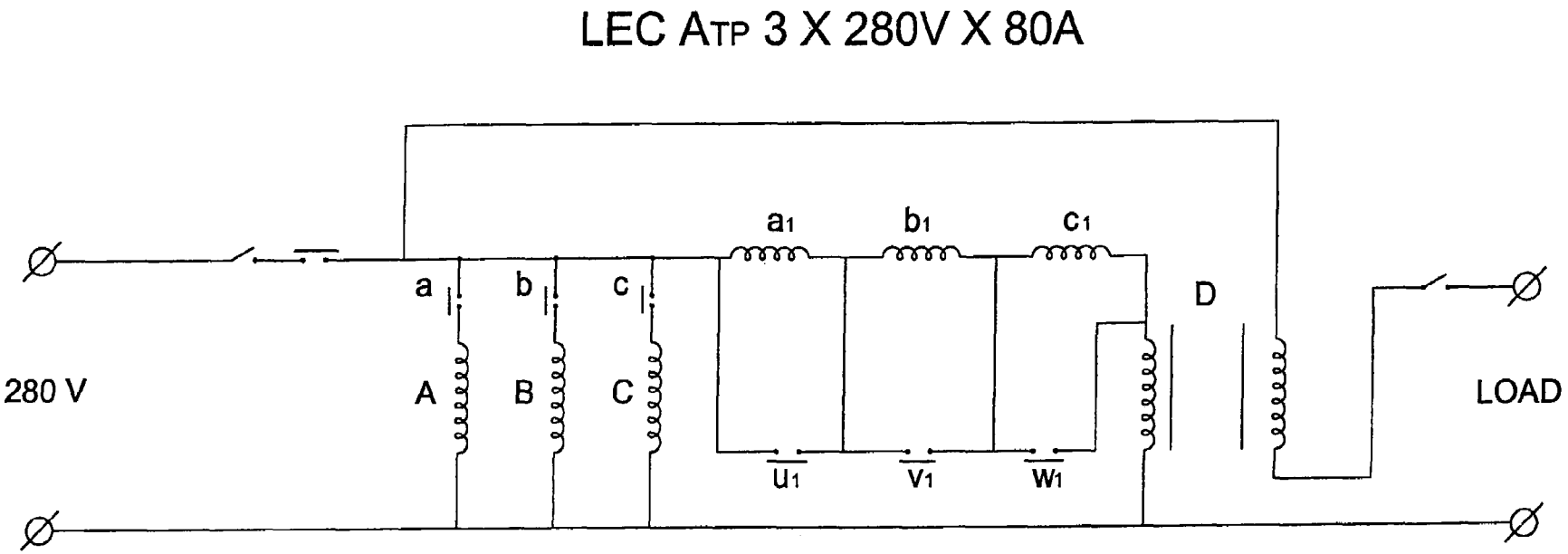
FIG. 5 is a schematic diagram of circuitry representing yet another preferred embodiment of the present invention.

Yet another preferred embodiment of the present invention is schematically represented in the circuit assembly of FIG. 5. More specifically, as described above with reference to the embodiments of FIGS. 2 through 4, the voltage reduction was achieved by the activation of one or more power transformers having a secondary winding connected in series with the inductance L. However, in the preferred embodiment of FIG. 5 the voltage reduction process is inverted and accomplished through the deactivation of power transformers, as set forth in greater detail hereinafter.

Advantages of the embodiment of FIG. 5:

The maximum reduction in voltage, which is directly related to energy consumption reduction, can be achieved when the power transformers are deactivated, there being less heat coming out of the unit. Therefore, forced ventilation is reduced resulting in greater efficiency.

With this type of internal operation mode, it is possible to work with voltages higher than 277V, which was the highest possible so far. This is possible since there is no high cross voltage in the contacts or terminals of associated switch assemblies.

While the previously described embodiments are unique and clearly distinguishable from related known or conventional control circuitry, especially in terms of power efficiency, certain limitations may be present, such as applications relating to voltages higher than 240V (L–N). Moreover, certain lighting applications are built to work at higher voltages such as:

3×277v+/−10% which is 249-305V (L–N) in the U.S.A.

1×480v+/−10% 432-528v (L–L) in the U.S.A.

3×347v+/−10% 312-381v (L–N) in Canada

Accordingly the improvement of the preferred embodiment is intended to withstand a higher voltage range from generally about 120v to 528v. Any limitation due to commutation energy being developed on the switching contacts of the "MINI CELL" transformers −5v, 10v, 20v is thereby overcome. With primary reference to FIG. 5, the preferred embodiment comprises feeder transformers (mini cells) A, B, and C, as well as a booster transformer D.

Each of the feeder transformers A, B and C switched between two modes comprising a reduced, defined voltage and zero voltage. Also, the feeder transformers A, B and C are wound in negative direction to the main and combined in a binary sequence.

For example, the three feeder transformers A, B and C will provide 8 levels of continuous voltages to the Booster transformer D. In that these feeder transformers are wound negatively between the net and primary winding of the booster transformer D, the output voltage may be controlled or regulated.

By way of example:

| | |
|---|---|
| Feeder transformers: | A 280 V/25 V |
| | B 280 V/50 V |
| | C 280 V/100 V |
| Booster transformer: | D280 V/40 V |

The binary combination of the feeder transformers A, B and/or C results in the following:

| Active transformers | Reduced voltage to the booster | Voltage at the primary booster | Voltage reduction to the output | Output voltage |
|---|---|---|---|---|
| None | O V | 280 V | 39.5 V | 241 V |
| A | −25 V | 255 V | 36 V | 244 V |
| B | −50 V | 230 V | 32.5 V | 247.5 V |

-continued

| Active transformers | Reduced voltage to the booster | Voltage at the primary booster | Voltage reduction to the output | Output voltage |
|---|---|---|---|---|
| A + B | −75 V | 205 V | 29 V | 251 V |
| C | −100 V | 180 V | 25.5 V | 254.5 V |
| A + C | −125 V | 155 V | 22 V | 258 V |
| B + C | −150 V | 130 V | 18.5 V | 261.5 V |
| A + B + C | −175 V | 105 V | 15 V | 265 V |

Further, the activation of each of the feeder transformers A, B and C is achieved by closing a switch or relay assembly associated with the primary winding of the feeder transformers A, B or C and opening independent or directly associated switch or relay assemblies a, b or c, as well as opening the appropriate switch or relay assemblies u1, v1 and w1 that shunts the secondary windings of the respective transformers. The deactivation is achieved by the opposite operation of the indicated and appropriate switch or relay assemblies. Accordingly, the operational and/or performance advantages especially in terms of efficiency, power transfer ratio and non wave distortion of the previously described embodiments is achievable through application of the preferred embodiment of FIG. 5. Further, the commutation phenomenon is resolved by not exposing the controlling switch or relay assemblies to high cross voltage.

The various preferred embodiments of the present invention thus provide an extremely simple and straightforward solution to a long lasting and well recognized problems relating to the inherent waste of electrical energy associated with lighting systems incorporating discharge lamps or bulbs.

While the above description is directed to appropriate specific structural and operational features, these should not be construed as limitations on the scope of the invention, but rather as exemplifications of the preferred embodiments. Those skilled in the art will envision other possible variations that are within the intended scope of the present invention. Accordingly, the scope of the invention should be determined not by the embodiment illustrated, but by the appended claims and their legal equivalents.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A control circuit structured to regulate a supply voltage to a predetermined load, said control circuit comprising:

at least one transformer including primary and secondary windings structured to generate fields of opposite polarity, said primary winding connected across the supply voltage and said secondary winding connected in series with at least one discharge bulb defining the predetermined load, at least one switching assembly comprising first and second operative positions and operatively associated with said one transformer, said first operative position comprising said primary winding connected across the supply voltage to induce a voltage of opposite polarity across said secondary winding, said second operative position comprising a disconnection of said primary winding and a shunt thereof to define a zero voltage across said secondary winding, and said at least one discharge bulb comprising a minimum operable voltage; said transformer structured to define a ratio between said primary and secondary windings capable of applying at least a minimally greater voltage to said one discharge bulb than said minimum operable voltage.

2. A control circuit as recited in claim 1 further comprising an inductance connected in series with said secondary winding and the predetermined load.

3. A control circuit as recited in claim 1 wherein said one switching assembly is positionable from said first operative position to said second operative position subsequent to ignition of said discharge bulb.

4. A control circuit as recited in claim 1 further comprising a plurality of transformers each including primary and secondary windings structured to generate fields of opposite polarity.

5. A control circuit as recited in claim 4 further comprising a plurality of switching assemblies each operatively associated with a different one of said plurality of transformers and comprising first and second operative positions.

6. A control circuit as recited in claim 5 wherein said discharge bulb comprises a minimum operable voltage; each of said transformers structured to define a ratio between said primary and secondary windings capable of applying an at least minimally greater voltage to said at least one discharge bulb than said minimum operable voltage.

7. A control circuit as recited in claim 5 wherein said plurality of switching assemblies are individually and collectively structured for successive actuation from said first operative position to said second operative position.

8. A control circuit as recited in claim 7 wherein said successive actuation establishes a progressive application of said minimally greater voltage to said at least one discharge bulb.

9. A control circuit as recited in claim 8 wherein a three phase supply voltage defines the supply voltage to the at least one discharge bulb.

10. A control circuit as recited in claim 8 further comprising said plurality of switching assemblies comprising remote control capabilities structured to accomplish said successive actuation of said plurality of switching assemblies remotely.

11. A control circuit as recited in claim 7 wherein at least one of said plurality of switching assemblies comprise a solenoid switch.

12. A circuit assembly for a lighting system structured to control supply voltage to a load of one or more discharge bulbs, said circuit assembly comprising:

a plurality of transformers each including primary and secondary windings structured to generate fields of opposite polarity, said primary winding of each of said plurality of transformers connected across the supply voltage and said secondary winding connected in series with the one or more discharge bulbs, said one or more discharge bulbs comprising a minimum operable voltage; each of said transformers structured to define a ratio between said primary and secondary and windings capable of applying a minimally greater voltage to said one or more discharge bulbs than said minimum operable voltage, a plurality of switching assemblies each is operatively associated with a different one of said plurality of transformers and comprising first and second operative positions, said first operative position of each of said plurality of switching assemblies comprising said primary winding of a corresponding one of said plurality of transformers connected across the supply voltage to induce a voltage of opposite polarity across said secondary winding of the corresponding one of the plurality of transformers, and said second operative position of each of said plurality of switching assemblies comprising a disconnection of said primary winding of a corresponding one of said plurality of transformers and a shunt thereof to define zero voltage across said secondary winding of the corresponding one of said plurality of transformers.

13. A circuit assembly as recited in claim 12 wherein said plurality of switching assemblies are individually and collectively structured for successive actuation from said first operative position to said second operative position.

14. A circuit assembly as recited in claim 13 wherein said plurality of switching assemblies are structured to establish a progressive application of said minimally greater voltage to said one or more discharge bulbs upon said successive activation thereof.

15. A circuit assembly as recited in claim 14 wherein the supply voltage to the one or more discharge bulbs comprises a three phase supply voltage.

16. A circuit assembly as recited in claim 14 wherein each of said plurality of switching assemblies comprise remote control capabilities structured to accomplish said successive actuation remotely.

* * * * *